US011054225B2

(12) United States Patent
Fesshaie et al.

(10) Patent No.: US 11,054,225 B2
(45) Date of Patent: Jul. 6, 2021

(54) IGNITOR FOR ELECTRONIC DETONATOR

(71) Applicant: HAMLIN ELECTRONICS (SUZHOU) LTD., Jiangsu (CN)

(72) Inventors: Efrem Fesshaie, Norwich (GB); Dong Liu, Jiangsu (CN); Paulius Kabisius, Kaunas (LT)

(73) Assignee: Hamlin Electronics (Suzhou) Ltd., Suzhou (CN)

( * ) Notice: Subject to any disclaimer, the term of this patent is extended or adjusted under 35 U.S.C. 154(b) by 55 days.

(21) Appl. No.: 16/474,957

(22) PCT Filed: Dec. 30, 2016

(86) PCT No.: PCT/CN2016/113427
§ 371 (c)(1),
(2) Date: Jun. 28, 2019

(87) PCT Pub. No.: WO2018/119999
PCT Pub. Date: Jul. 5, 2018

(65) Prior Publication Data

US 2019/0346243 A1 Nov. 14, 2019

(51) Int. Cl.
*F42B 3/12* (2006.01)
*F42B 3/198* (2006.01)

(52) U.S. Cl.
CPC ..... *F42B 3/124* (2013.01); *F42B 3/121* (2013.01); *F42B 3/122* (2013.01); *F42B 3/198* (2013.01)

(58) Field of Classification Search
CPC .. F42B 3/13; F42B 3/124; F42B 3/198; F42B 3/121; F42B 3/122; F42D 1/05; F42D 1/045

(Continued)

(56) References Cited

U.S. PATENT DOCUMENTS 3,116,900 A * 1/1964 Fulton ..... B64D 25/10 244/122 AD
3,211,097 A * 10/1965 Foote ..... F42B 3/124 102/202.14

(Continued)

FOREIGN PATENT DOCUMENTS

CN 201607180 U 10/2010
CN 102095337 A 6/2011

(Continued)

OTHER PUBLICATIONS (NPL: Detonators Go Surface-Mount; Steve Bush; Apr. 20, 2015; https://www.electronicsweekly.com/news/products/passives-products/detonators-go-surface-mount-2015-04/) (Year: 2015).*

(Continued)

*Primary Examiner* — Joshua E Freeman
(74) *Attorney, Agent, or Firm* — Kacvinsky Daisak Biuni PLLC

(57) ABSTRACT

An ignitor for an electronic detonator, the ignitor including a microcontroller and a capacitor mounted on a printed circuit board (PCB) and electrically connected to one another, the microcontroller configured to discharge the capacitor in response to an actuation signal received by the microcontroller, a pair of conductive traces extending from the capacitor, a resistive element extending between the conductive traces and configured to radiate heat in response to current flowing therethrough, and a shroud disposed over the resistive element, the shroud containing a pyrotechnic composition that at least partially covers the resistive element.

5 Claims, 2 Drawing Sheets

(58) Field of Classification Search
USPC ..... 102/202.7
See application file for complete search history.

(56) References Cited

U.S. PATENT DOCUMENTS 3,366,054 A * 1/1968 Gruber, Jr. ..... F42B 3/124 102/202.11
4,023,497 A * 5/1977 Morris ..... C06C 9/00 102/380
6,050,599 A * 4/2000 Marsaud ..... B60R 21/2644 280/736
6,298,789 B1 * 10/2001 Ericsson ..... B60R 21/264 102/530
6,752,083 B1 * 6/2004 Lerche ..... E21B 43/1185 102/202.5
2002/0152919 A1 * 10/2002 Laucht ..... F42B 33/025 102/530
2003/0070575 A1 * 4/2003 Daoud ..... C06C 9/00 102/531
2003/0221576 A1 * 12/2003 Forman ..... F42B 3/121 102/202.5
2005/0015473 A1 * 1/2005 Teowee ..... F42D 1/05 709/223
2006/0150855 A1 * 7/2006 Maruyama ..... F42B 3/103 102/202.14
2009/0293752 A1 * 12/2009 Jordan ..... F42B 3/10 102/202.14
2013/0125772 A1 * 5/2013 Backhus ..... F42D 1/05 102/206
2014/0326154 A1 11/2014 Birkin et al.

FOREIGN PATENT DOCUMENTS

CN 203310310 U 11/2013
CN 104154829 A 11/2014

OTHER PUBLICATIONS

International Search Report from PCT/CN2016/113427 dated Aug. 30, 2017, 3 pages.
Written Opinion from PCT/CN2016/113427 dated Aug. 30, 2017, 4 pages.

* cited by examiner

IGNITOR FOR ELECTRONIC DETONATOR

FIELD OF THE DISCLOSURE

The present disclosure relates generally to the field of explosives, and relates more particularly to an improved ignitor for electronic detonators.

BACKGROUND

Electronic detonators are commonly used in a variety of applications, including military and industrial applications, for facilitating safe and reliable detonation of explosive materials. A typical electronic detonator may include an electronically-actuated ignitor that is configured to ignite a primary charge, which may in-turn ignite a more powerful secondary charge. The ignitor may include a capacitor with a pair of electrical leads extending therefrom. The leads may be connected to one another by a resistive element that is configured to emit heat when current passes therethrough. The resistive element may be a length of wire (e.g., nichrome wire), referred to as a "bridge wire," or may be a surface mount resistor, referred to as a "bridge resistor." The resistive element may be coated with a quantity of pyrotechnic composition that may be ignited when the capacitor is discharged through the leads and the resistive element. The ignited pyrotechnic composition may burn at a sufficiently high temperature to ignite the primary charge.

During manufacture of an electronic detonator, a pyrotechnic composition is commonly applied to the resistive element of an ignitor by hand-dipping the resistive element into the pyrotechnic composition, after which the pyrotechnic composition is allowed to cure into a solid mass that coats the resistive element. This technique is associated with several shortcomings. For example, it requires a worker to be in close proximity to, and sometimes in direct contact with, the pyrotechnic composition, which can be hazardous. Additionally, it is difficult to control the amount of pyrotechnic composition that is applied to the resistive element during dipping. If too little of the pyrotechnic composition is applied, the ignitor may fail to ignite the primary charge of a detonator. If too much of the pyrotechnic composition is applied, the composition may be wasted, needlessly increasing the cost of the detonator.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of an ignitor for an electronic detonator in accordance with the present disclosure may include a microcontroller and a capacitor mounted on a printed circuit board (PCB) and electrically connected to one another, the microcontroller configured to discharge the capacitor in response to an actuation signal received by the microcontroller, a pair of conductive traces extending from the capacitor, a resistive element extending between the conductive traces and configured to radiate heat in response to current flowing therethrough, and a shroud disposed over the resistive element, the shroud containing a pyrotechnic composition that at least partially covers the resistive element.

An exemplary embodiment of an electronic detonator in accordance with the present disclosure may include a tubular shell having a closed end and an open end, an ignitor disposed within the shell, the ignitor including a microcontroller and a capacitor mounted on a printed circuit board (PCB) and electrically connected to one another, the microcontroller configured to discharge the capacitor in response to an actuation signal received by the microcontroller, a pair of conductive traces extending from the capacitor, a resistive element extending between the conductive traces, and a shroud disposed over the resistive element, the shroud containing a pyrotechnic composition that at least partially covers the resistive element, the detonator further including a charge disposed within the shell adjacent an open end of the shroud, the charge adapted to be ignited by burning of the pyrotechnic composition.

An exemplary embodiment of a method for manufacturing an ignitor for an electronic detonator in accordance with the present disclosure may include mounting a microcontroller and a capacitor on a printed circuit board (PCB) in electrical communication with one another, with a pair of conductive traces extending from the capacitor, the microcontroller configured to discharge the capacitor upon receiving an actuation signal, the method further including connecting the conductive traces to one another with a resistive element adapted to radiate heat in response to current flowing therethrough, placing a shroud over the resistive element, and filling the shroud with a pyrotechnic composition that at least partially covers the resistive element.

DETAILED DESCRIPTION

Figure 1:
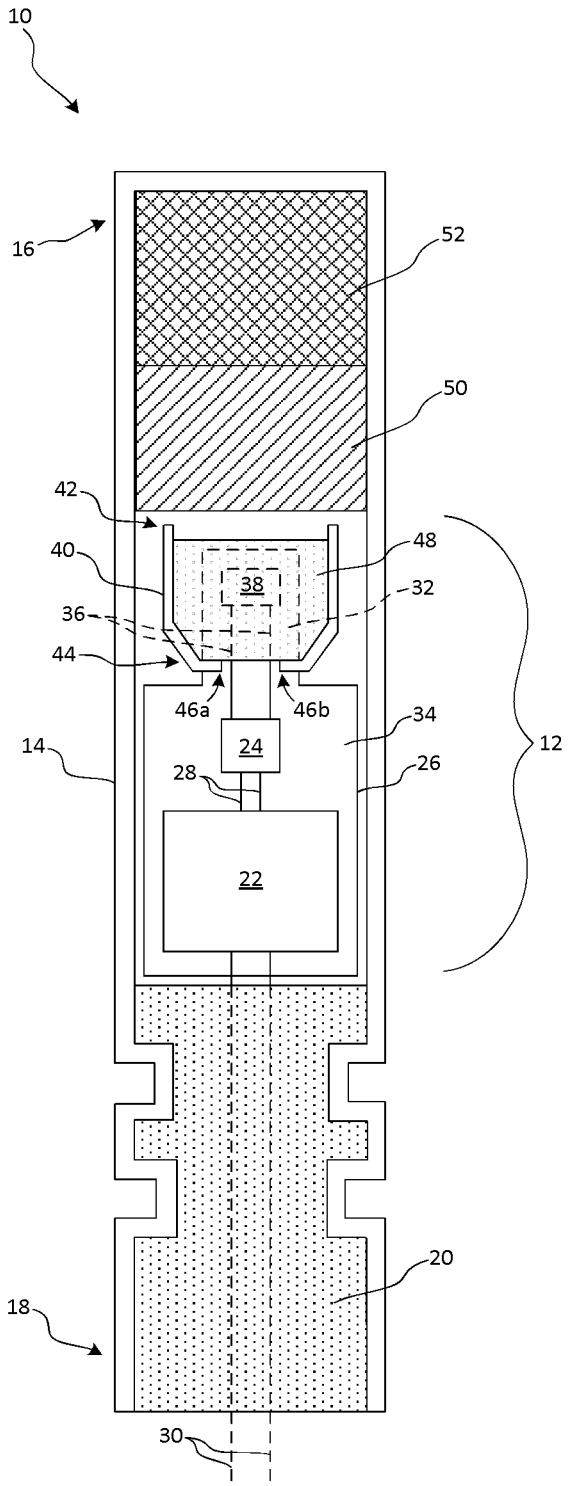
FIG. 1 is a schematic cut-away view illustrating an interior of an electronic detonator including an ignitor in accordance an exemplary embodiment of the present disclosure.

Embodiments of an improved ignitor for an electronic detonator in accordance with the present disclosure will now be described more fully hereinafter with reference to the accompanying drawings, in which preferred embodiments of the present disclosure are presented. The ignitor of the present disclosure may, however, be embodied in many different forms and should not be construed as being limited to the embodiments set forth herein. Rather, these embodiments are provided so that this disclosure will convey certain exemplary aspects of the ignitor to those skilled in the art. In the drawings, like numbers refer to like elements throughout unless otherwise noted.

Referring to FIG. 1, a schematic cut-away view illustrating an interior of an electronic detonator 10 including an improved ignitor 12 in accordance with an exemplary, non-limiting embodiment of the present disclosure is shown. The detonator 10 may include a tubular shell 14 having a closed end 16 and an open end 18. The open end 18 of the shell 14 may be plugged with a plug 20 formed of a resilient, electrically insulating material (e.g., rubber, silicone, etc.) for preventing environmental elements (e.g., water, dust, particulate matter, etc.) from entering the shell 14. The shell 14 may be crimped onto the plug 20 for establishing a hermetic seal therebetween and for preventing the plug 20 from being inadvertently removed from of the shell 14.

The ignitor 12 of the detonator 10 may include a microcontroller 22 and a capacitor 24 mounted on a printed circuit board (PCB) 26. The microcontroller 22 may be operatively connected to the capacitor 24 by conductive traces 28 on the PCB 26, and may be configured to facilitate charging and discharging of the capacitor 24 as further described below. A pair of leg wires 30 may extend through the plug 20 and may be connected to the microcontroller 22. The leg wires may 30 be provided for supplying electrical signals to the microcontroller 22, such as may be transmitted from a control device (not shown) remote from the detonator 10.

The PCB 26 may include a peninsular portion 32 extending from a relatively wider main portion 34. A pair of conductive terminals or traces 36 may extend from the capacitor 24 onto the peninsular portion 32. The conductive traces 36 may be connected to one another by a resistive element 38 extending between the conductive traces 36. The resistive element 38 may be adapted to radiate heat in response to current flowing therethrough. In various embodiments of the ignitor 12, the resistive element 38 may be a surface mounted bridge resistor that may be installed on the PCB 26 using surface-mount technology (SMT) manufacturing methods that will be familiar to those of ordinary skill in the art. In other embodiments of the ignitor 12, the resistive element 38 may be a bridge wire (e.g., a length of nichrome wire) that may be soldered to the conductive traces 36.

The ignitor 12 may further include a metallic housing or shroud 40 that surrounds and partially encloses the peninsular portion 32 of the PCB 26 including the resistive element 38. The shroud 40 may be a substantially cup-shaped member with an open end 42 and an opposing closed end 44. The peninsular portion 32 may extend through the closed end 44, and the closed end 44 may be secured to the peninsular portion 32. For example, as shown in FIG. 1, the closed end 44 may be crimped or pressed into notches 46*a*, 46*b* formed in the sides of the peninsular portion 32. The present disclosure is not limited in this regard, and it is contemplated that the shroud 40 may be secured to the peninsular portion 32 of the PCB 26 using any of a variety of mechanical fastening means. In various other embodiments of the ignitor 12, the shroud 40 may additionally or alternatively be fastened to the main portion 34 of the PCB 26 and/or to an interior of the shell 14.

The shroud 40 may be partially or entirely filled with a quantity of pyrotechnic composition 48 that covers the resistive element 38. The pyrotechnic composition 48 may be a chemical composition that is adapted to be ignited via heating of the resistive element 38 and that may burn at a temperature sufficient to ignite an adjacent charge as further described below. The pyrotechnic composition 48 may be any of a variety of chemical compositions including, but not limited to, zirconium-potassium perchlorate, boron-potassium nitrate, aluminum-potassium perchlorate, and titanium-aluminum-potassium perchlorate. All such compositions may be referred to generically as "pyrogens."

The pyrotechnic composition 48 may be poured or injected into the shroud 40 in a liquid or semi-liquid state and may subsequently be cured or dried to form a solid mass that at least partially envelopes the resistive element 38. Thus, the shroud 40 provides a receptacle for holding the liquid or semi-liquid pyrotechnic composition 48 which may be poured or injected into the shroud 40 using an automated process. This provides numerous advantages relative to conventional manual dipping methods in which a resistive element of an ignitor is hand-dipped into a liquid pyrotechnic composition. For example, workers need not be in close proximity to the pyrotechnic composition, thus increasing safety of the manufacturing process. Additionally, a very precise quantity of pyrotechnic composition may be poured or injected into shroud 40 to cover the resistive element 38, ensuring that an effective amount of pyrotechnic composition is applied to the resistive element 38 while minimizing or eliminating waste of the pyrotechnic composition.

The detonator 10 may further include a primary charge 50 and a secondary charge 52. The primary charge 50 may be disposed adjacent the open end 44 of the shroud 40 and may be adapted to be ignited by heat radiated by the pyrotechnic composition 48 upon burning thereof. The primary charge 50 may be or may include any type of conventional primary explosive material, including, but not limited to, ASA compound (lead azide, lead styphnate, and aluminum) and/or diazo dinitro phenol (DDNP). The secondary charge 52 may be disposed adjacent the primary charge 50 and may be adapted to be ignited by heat radiated by the primary charge 50 upon burning thereof. The secondary charge 52 may be or may include any type of conventional secondary explosive material, including, but not limited to, trinitrotoluene (TNT), tetryl, pentaerythritol tetranitrate, and/or RDX. Alternative embodiments of the detonator 10 are contemplated in which the primary charge 50 may be omitted and the secondary charge 52 may be disposed adjacent to, and may be adapted to be ignited directly by, the pyrotechnic composition 48.

During typical use of the detonator 10, an actuation signal may be transmitted to the microcontroller 22 via the leg wires 30 (e.g., from a remote control device). Upon receiving the actuation signal, the microcontroller 22 may cause the electrically charged capacitor 24 to be discharged through the conductive traces 36 and through the resistive element 38. In various embodiments, the microcontroller 22 may include logic that may be configured to provide a predetermined delay between receipt of the actuation signal and discharging of the capacitor 24. Upon discharging of the capacitor 24, the resistive element 38 may radiate a sufficient amount of heat to ignite the pyrotechnic composition 48. Heat emitted by the burning pyrotechnic composition 48 may ignite the primary charge 50, which may in-turn ignite the secondary charge 52, resulting in a concussive blast. Advantageously, heat emitted by the burning pyrotechnic composition 48 may be reflected and deflected by the interior surface of the shroud 40 toward the primary charge 50. The shroud 40 thus facilitates a more efficient transfer of heat from the burning pyrotechnic composition 48 to the primary charge 50 relative to conventional electronic ignitors that do not have a shroud. Thus, a smaller quantity of pyrotechnic composition 48 may be used in the ignitor 12 relative to conventional electronic ignitors, thereby reducing the cost of the ignitor 12 relative to conventional electronic ignitors.

The schematic illustration of the ignitor 12 provided in FIG. 1 is a highly-simplified representation that is intended to convey certain aspects of the ignitor 12 that are pertinent to the present disclosure. Those of ordinary skill in the art will appreciate that the ignitor 12 may include numerous additional elements that are commonly implemented in electronic ignitors, such elements being omitted from FIG. 1 for the sake of clarity. Such elements may include various electronic components that may be mounted on the PCB 26 that may be provided for facilitating and/or complementing the operation of the microcontroller 22 and/or the capacitor 24.

Figure 2:
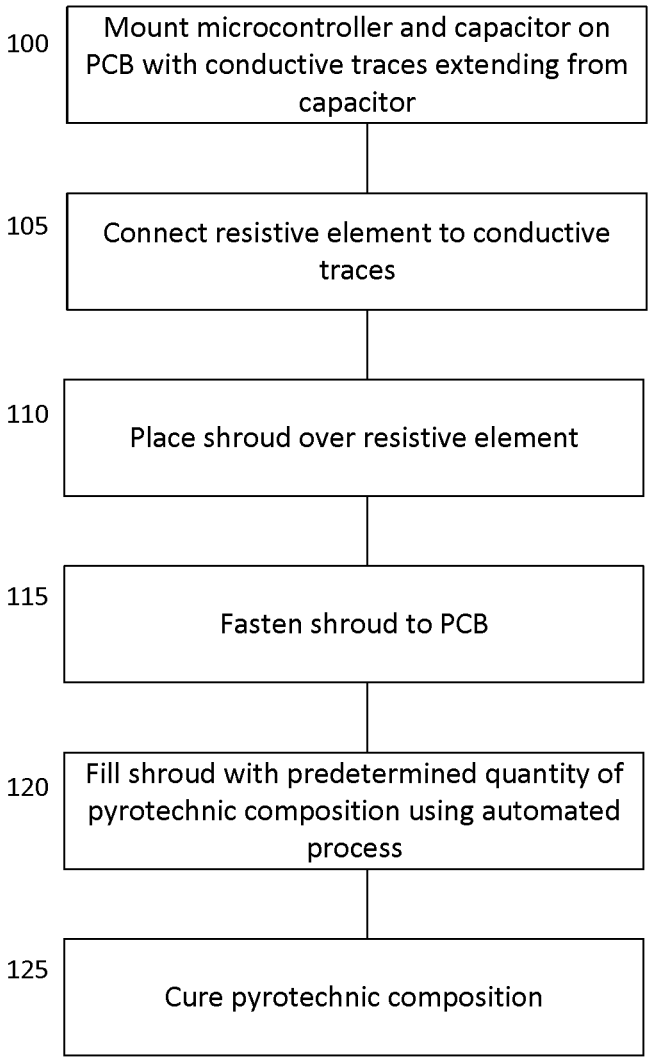
FIG. 2 is a flow diagram illustrating an exemplary method of manufacturing the ignitor shown in FIG. 1.

Referring to FIG. 2, a flow diagram illustrating an exemplary method for manufacturing the above-described ignitor 12 in accordance with the present disclosure is shown. The method will now be described in conjunction with the schematic illustration of the detonator 10 shown in FIG. 1.

At step 100 of the exemplary method presented in FIG. 2, the microcontroller 22 and the capacitor 24 may be mounted on the PCB 26 and may be operatively connected to one another by conductive traces 28. A pair of conductive traces 36 may extend from the capacitor 24. At step 105 of the method, the conductive traces 36 may be connected to one another by the resistive element 38. In various embodiments of the ignitor 12, the resistive element 38 may be a surface mounted bridge resistor that may be installed on the PCB 26 using surface-mount technology (SMT) manufacturing methods that will be familiar to those of ordinary skill in the art. In other embodiments of the ignitor 12, the resistive element 38 may be a bridge wire (e.g., a length of nichrome wire) that may be soldered to the conductive traces 36. In some embodiments, the resistive element 38 may be mounted on a peninsular portion 32 of the PCB 26 that extends form a relatively wider main portion 34 of the PCB 26 upon which the microcontroller 22 and capacitor 24 are mounted.

The microcontroller 22 may be configured to cause the capacitor 24 to discharge current through conductive traces 36 and through the resistive element 38 in response to an actuation signal transmitted to the microcontroller via the leg wires 30. In some embodiments, the microcontroller 22 may be configured (e.g., programmed) to provide a delay of predetermined length between receiving the actuation signal and causing discharge of the capacitor 24.

At step 110 of the exemplary method, the shroud 40 may be placed over the peninsular portion 32 of the PCB 26 and the resistive element 38 with the peninsular portion 32 extending through the end 44 of the shroud 40. At step 115 of the method, the end 44 of the shroud 40 may be fastened to the PCB 26 in a manner that substantially closes the end 44 about the peninsular portion 32. For example, in some embodiments the end 44 may be crimped or pressed into notches 46*a*, 46*b* formed in the sides of the peninsular portion 32. The present disclosure is not limited in this regard, and it is contemplated that the shroud 40 may be secured to the peninsular portion 32 of the PCB 26 using any of a variety of mechanical fastening means. In various other embodiments of the ignitor 12, the shroud 40 may additionally or alternatively be fastened to the main portion 34 of the PCB 26 and/or to an interior of the shell 14.

At step 120 of the exemplary method, a precise, predetermined quantity of the pyrotechnic composition 48 in a liquid or semi-liquid state may be disposed in the shroud 40 using an automated process and may at least partially cover the resistive element 38. In some embodiments of the present method, the pyrotechnic composition 48 may be injected into the open end 42 of the shroud 40 using an automated process (e.g., using an automated device that is configured to inject a precise, predetermined quantity of the pyrotechnic composition 48 into the shroud 42). In other embodiments of the present method, the pyrotechnic composition 48 may be poured into the open end 42 of the shroud 40 using an automated process (e.g., using an automated device that is configured to pour a precise, predetermined quantity of the pyrotechnic composition 48 into the shroud 42). At step 125 of the method, the pyrotechnic composition 48 may be cured or dried to form a solid mass that envelopes the resistive element 38.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A method of manufacturing an ignitor for an electronic detonator, the method comprising:

mounting a microcontroller and a capacitor on a printed circuit board (PCB) in electrical communication with one another, with a pair of conductive traces extending from the capacitor, the microcontroller configured to discharge the capacitor upon receiving an actuation signal;

connecting the conductive traces to one another with a resistive element adapted to radiate heat in response to current flowing therethrough;

placing a shroud over the resistive element, the shroud disposed within, and separate from, a tubular shell of the electronic detonator, the shroud disposed over the resistive element and having an open end directed away from the PCB; and filling the shroud with a pyrotechnic composition that at least partially covers the resistive element by disposing a predetermined quantity of the pyrotechnic composition in a liquid or semi-liquid state in the shroud using an automated process.

2. The method of claim 1, wherein the resistive element is mounted on a peninsular portion of the PCB that extends from a relatively wider main portion of the PCB upon which the microcontroller and the capacitor are mounted, and wherein placing the shroud over the resistive element comprises crimping a first end of the shroud into notches formed in sides of the peninsular portion with a second, open end of the shroud oriented to direct heat radiated by the pyrotechnic composition in a predetermined direction.

3. The method of claim 1, wherein connecting the conductive traces to one another with the resistive element comprises installing a surface mount resistor on the PCB using a surface mount technology (SMT) process.

4. The method of claim 1, wherein connecting the conductive traces to one another with the resistive element comprises soldering a bridge wire to the conductive traces.

5. The method of claim 1, further comprising allowing the pyrotechnic composition to cure or dry into a solid mass that at least partially envelopes the resistive element.

* * * * *